US008216702B2

(12) United States Patent
Johansson et al.

(10) Patent No.: US 8,216,702 B2
(45) Date of Patent: Jul. 10, 2012

(54) COATED CUTTING TOOL FOR METAL CUTTING APPLICATIONS GENERATING HIGH TEMPERATURES

(75) Inventors: Mats Johansson, Linkoping (SE); Lina Rogstrom, Linkoping (SE); Lars Johnson, Linkoping (SE); Magnus Oden, Tullinge (SE); Lars Hultman, Linkoping (SE); Greger Hakansson, Linkoping (SE); Marianne Collin, Alvsjo (SE); Jacob Sjolen, Fagersta (SE)

(73) Assignee: Seco Tools AB, Fagersta (SE)

( * ) Notice: Subject to any disclaimer, the term of this patent is extended or adjusted under 35 U.S.C. 154(b) by 0 days.

(21) Appl. No.: 13/160,838

(22) Filed: Jun. 15, 2011

(65) Prior Publication Data

US 2012/0009402 A1 Jan. 12, 2012

Related U.S. Application Data

(62) Division of application No. 12/995,829, filed as application No. PCT/SE2009/050696 on Jun. 9, 2009, now abandoned.

(30) Foreign Application Priority Data

Jun. 13, 2008 (SE) ..... 0801379

(51) Int. Cl.
*B32B 9/00* (2006.01)

(52) U.S. Cl. ..... 428/697; 51/307; 51/309; 407/119; 428/216; 428/325; 428/336; 428/472; 428/698; 428/699

(58) Field of Classification Search ..... 51/307, 51/309; 428/216, 325, 336, 469, 472, 697, 428/698, 699; 407/119
See application file for complete search history.

(56) References Cited

U.S. PATENT DOCUMENTS

| | | | | |
|---|---|---|---|---|
| 6,255,007 | B1 * | 7/2001 | dos Santos Pereira Ribeiro | 428/697 |
| 7,258,933 | B2 * | 8/2007 | Takaoka et al. | 428/699 |
| 2007/0111032 | A1 * | 5/2007 | Nagano et al. | 428/698 |
| 2009/0130434 | A1 * | 5/2009 | Zhu et al. | 407/119 |

FOREIGN PATENT DOCUMENTS

| | | | |
|---|---|---|---|
| EP | 0448720 | A1 | 10/1991 |
| EP | 603486 | * | 12/1995 |
| EP | 1378304 | A2 | 1/2004 |
| EP | 1785504 | A2 | 5/2007 |

(Continued)

OTHER PUBLICATIONS

Rafaja D. et al, "Formation of defect structures in hard nanocomposites", Surface & Coatings Technology 2008, vol. 203, p. 572-578.

(Continued)

*Primary Examiner* — A. A. Turner
(74) *Attorney, Agent, or Firm* — Young & Thompson

(57) ABSTRACT

A cutting tool insert includes a body of cemented carbide, cermet, ceramics, high speed steel (HSS), polycrystalline diamond (PCD) or polycrystalline cubic boron nitride (PCBN), a hard and wear resistant coating is applied, grown by physical vapour deposition (PVD) such as cathodic are evaporation or magnetron sputtering. The coating includes at least one layer of $(Zr_xAl_{1-x})N$ with $0.05<x<0.30$ with a thickness between 0.5 and 10 μm. The layer has a nanocrystalline columnar microstructure consisting of a single cubic phase or a mixture of hexagonal and cubic phases. The insert is particularly useful in metal cutting applications generating high temperatures with improved edge integrity.

20 Claims, 2 Drawing Sheets

FOREIGN PATENT DOCUMENTS

| | | |
|---|---|---|
| JP | 06-322517 | * 11/1994 |
| JP | 2000-326108 | * 11/2000 |

OTHER PUBLICATIONS

Hasegawa Hiroyuki et al, "Effects of A1 contents on microstructures of Cr1-xA1xN and Zr1-xA1xN films synthesized by cathodic arc method", Surface & Coatings Technology 2005, vol. 200, p. 2409-2413.

Hasegawa Hiroyuki et al, "Effects of second metal contents on microstructure and micro-hardness of ternary nitride films synthesized by cathodic arc method", Surface & Coatings Technology 2004, vol. 188-189, p. 234-240.

Lamni R. et al, "Microstructure and nanohardness properties of Zr-A1-N and Zr-Cr-N thin films", J. Vac. Sci. Technol. A Jul./Aug. 2005, vol. 23, No. 4, p. 593-598.

Dejun Li, "Synthesis of ZrAIN coatings with thermal stability at high temperature", Science in China Series E: Technological Sciences 2006, vol. 49, No. 5, p. 576-581.

Lamni R et al: "Electrical and optical properties of Zr1-xA1xN thin films", Thin Solid Films, May 1, 2005, vol. 478, No. 1-2, pp. 170-175, XP004774116.

European Search Report, dated Apr. 15, 2011, in Application No. EP 09762755.

International Search Report, dated Sep. 11, 2009, in PCT/SE2009/050696.

* cited by examiner

COATED CUTTING TOOL FOR METAL CUTTING APPLICATIONS GENERATING HIGH TEMPERATURES

CROSS REFERENCE TO RELATED APPLICATIONS

This application is a division of application Ser. No. 12/995,829 filed on Dec. 2, 2010; which is the 35 U.S.C. 371 national stage of International application PCT/SE2009/050696 filed on Jun. 9, 2009; which claimed priority to Swedish application 0801379-9 filed Jun. 13, 2008. The entire contents of each of the above-identified applications are hereby incorporated by reference.

BACKGROUND OF THE INVENTION

The present invention relates to a cutting tool insert for machining by chip removal and wear resistant coating comprising at least one (Zr,Al)N layer with a low Zr content grown by physical vapour deposition (PVD) and preferably by cathodic are evaporation or magnetron sputtering. This insert is particularly useful in metal cutting applications generating high temperatures, e.g., machining of steel, stainless steel and hardened steel.

TiN-layers have been widely used for surface protective applications. In order to improve the oxidation resistance of these layers, work began in the mid-1980's with adding aluminum to TiN. The compound thus formed, cubic-phase $(Ti_xAl_{1-x})N$, was found to have superior oxidation resistance and enabled greater cutting speeds during machining, prolonged tool life, machining of harder materials, and improved manufacturing economy. Improved coating performance in metal cutting applications has been obtained by precipitation hardening of $(Ti_xAl_{1-x})N$ and also disclosed in U.S. Pat. No. 7,083,868 and U.S. Pat. No. 7,056,602.

$Zr_{1-X}Al_XN$ ($0 \leqq x \leqq 1.0$) layers have been synthesized by the cathodic are evaporation using alloyed and/or metal cathodes, H. Hasegawa et al, Surf. Coat. Tech. 200 (2005). The peaks of $Zr_{1-X}Al_XN$ (x=0.37) showed a NaCl structure that changed to a wurtzite structure at x=0.50.

EP 1 785 504 discloses a surface-coated base material and a high hardness coating formed on or over said base material. Said high hardness coating comprises a coating layer containing a nitride compound with Al as main component and at least one element selected from the group consisting of Zr, Hf, Pd, Jr and the rare earth elements.

US 2002/0166606 discloses a method of coating a metal substrate by a metal compound coating comprising TiN, TiCN, AlTiN, TiAlN, ZrN, ZrCN, AlZrCN, or AlZrTiN using a vacuum chamber process such as physical vapor deposition (PVD) or chemical vapor deposition (CVD).

The trends towards dry-work processes for environmental protection, i.e., metal cutting operation without using cutting fluids (lubricants) and accelerated machining speed with improved process put even higher demands on the characteristics of the tool materials due to an increased tool cutting-edge temperature. In particular, coating stability at high temperatures, e.g., oxidation- and wear-resistance, has become even more crucial.

It is an object of the present invention to provide a coated cutting tool insert with improved performance in metal cutting applications at elevated temperatures.

Surprisingly, a low Zr content in (Zr,Al)N layers deposited on cutting tools inserts significantly improves their high temperature performance and edge integrity during metal cutting.

DETAILED DESCRIPTION OF THE INVENTION

Figure 1:
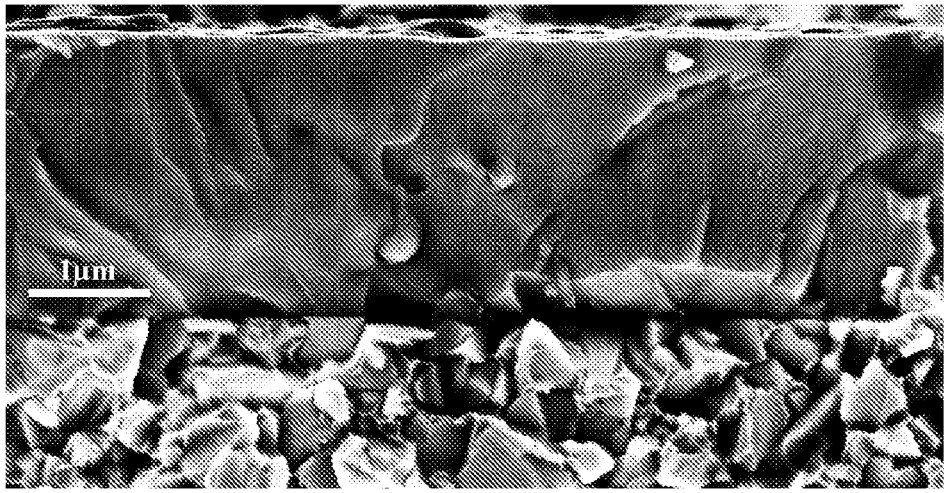
FIG. 1; A scanning electron microscope (SEM) micrograph of a fractured $(Zr_{0.17}Al_{0.83})N$ layer.

According to the present invention, there is provided a cutting tool insert for machining by chip removal comprising a body of a hard alloy of cemented carbide, cermet, ceramics, high speed steel (HSS), polycrystalline diamond (PCD) or polycrystalline cubic boron nitride (PCBN), preferably cemented carbide and cermet, onto which a wear resistant coating is deposited comprising at least one $(Zr_xAl_{1-x})N$ layer with $0.05<x<0.30$, preferably $0.10<x<0.25$, most preferably $0.15<x<0.20$, as determined by, e.g., EDS or WDS techniques, consisting of a single cubic phase or a single hexagonal phase or a mixture thereof, preferably a mixture of cubic and hexagonal phases with predominantly cubic phase, as determined by X-ray diffraction. The elemental composition is, within the measurement accuracy, preferably with a variation less than 10% throughout the layer. Variation of the composition may also occur due to normal process variations during deposition such as, e.g., rotation of the insert holder during deposition.

Said layer is 0.5 to 10 μm, preferably 0.5 to 5 μm thick, and has a nanocrystalline columnar microstructure with an average columnar width of <500 nm, preferably <100 nm, most preferably <50 nm, as determined by cross sectional transmission electron microscopy of a middle region of the layer, i.e., a region within 30 to 70% of the thickness in the growth direction, and said average columnar width is the average from measuring the width of at least ten adjacent columns.

Said columns preferably comprise nanocrystalline regions with an average crystallite size <100 nm, preferably <50 nm, most preferably <25 nm, as determined by cross sectional transmission electron microscopy of the middle region of said layer i.e., a region within 30 to 70% of the layer thickness in the growth direction. Said crystallite size is determined as the average from measuring the size of at least ten adjacent crystallites.

Said as-deposited (Zr,Al)N layer with its nanocrystalline structure has a hardness >25 GPa and preferably <45 GPa.

The body may further be coated with an inner single- and/or multilayer coating of, preferably TiN, TiC, Ti(C,N) or (Ti,Al)N, most preferably TiN or (Ti,Al)N, and/or an outer single- and/or multilayer coating of, preferably TiN, TiC, Ti(C,N), (Ti,Al)N or oxides, most preferably TiN or (Ti,Al)N, to a total coating thickness, including the (Zr,Al)N layer, of 0.7 to 20 μm, preferably 1 to 10 μm, and most preferably 2 to 7 μm.

The deposition methods for the layers of the present invention are based on PVD, e.g., cathodic are evaporation or magnetron sputtering using one or more pure and/or alloyed metal (Zr,Al) cathodes or targets, respectively, resulting in the desired layer composition.

In the case of cathodic are evaporation, (Zr,Al)N layers are grown with an evaporation current between 50 and 200 A depending on the cathode size. The layers are grown in a mixed $Ar+N_2$ atmosphere, preferably in a pure $N_2$, at a total pressure between 1.0 and 7.0 Pa, preferably between 1.5 and 4.0 Pa. The bias is between 0 and −300 V, preferably between −10 and −150 V, with a deposition temperature between 200 and 800° C., preferably between 300 and 600° C.

In the case of magnetron sputtering, (Zr,Al)N layers are grown with a power density applied to the sputter target between 0.5 and 15 W/cm$^2$, preferably between 1 and 5 W/cm$^2$. The layers are grown in a mixed $Ar+N_2$ or pure $N_2$ atmosphere at a total pressure between 0.13 and 7.0 Pa, preferably between 0.13 and 2.5 Pa. The bias is between 0 and −300 V, preferably between −10 and −150 V, with a deposition temperature between 200 and 800° C., preferably between 300 and 600° C.

The invention also relates to the use of cutting tool inserts according to the above for machining of steel, stainless steel and hardened steel at cutting speeds of 50-500 m/min, preferably 75-400 m/min, with an average feed, per tooth in the case of milling, of 0.08-0.5 mm, preferably 0.1-0.4 mm, depending on cutting speed and insert geometry.

Example 1

Cemented carbide inserts with composition 94 wt % WC-6 wt % Co (fine grained) were used.

Before deposition, the inserts were cleaned according to standard practice. The deposition system was evacuated to a pressure of less than 0.08 Pa, after which the inserts were sputter cleaned with Ar ions. Single $(Zr_xAl_{1-x})N$ layers were grown using cathodic are evaporation using (Zr,Al) cathodes, resulting in a layer compositions between $0.02<x<0.99$. The layers were grown at 400° C., in pure $N_2$ atmosphere at a total pressure of 2.5 Pa, using a bias of −100 V and an evaporation current between 100 A and 150 A (higher current for Zr concentration >50 at %) to a total thickness of 3 μm.

FIG. 1 shows a SEM micrograph of a typical layer in a (fractured) cross-section according to the invention with a glassy appearance common for nanocrystalline structures.

The metal composition, x, of the $(Zr_xAl_{1-x})N$ layers was obtained by energy dispersive spectroscopy (EDS) analysis area using a LEO Ultra 55 scanning electron microscope with a Thermo Noran EDS. Industrial standards and ZAF correction were used for the quantitative analysis and evaluated using a Noran System Six (NSS version 2) software (see table 1).

TABLE 1

| Layer | x in $(Zr_xAl_{1-x})N$ |
|---|---|
| zr-211 | 0.02 |
| zr-221 | 0.10 |
| zr-111 | 0.17 |
| zr-121 | 0.17 |
| zr-131 | 0.19 |
| zr-011 | 0.26 |
| zr-021 | 0.30 |
| zr-031 | 0.33 |
| zr-041 | 0.48 |
| zr-051 | 0.50 |
| zr-012 | 0.65 |
| zr-062 | 0.76 |
| zr-092 | 0.99 |

In order to simulate age hardening, i.e., an increased hardening effect of the coating with time, accelerated test conditions were used by conducting controlled isothermal heat treatments of the inserts in inert Ar atmosphere up to 1200° C. for 120 min. Also, this is the typical temperature close to the cutting edge of the insert during metal machining.

Figure 2:
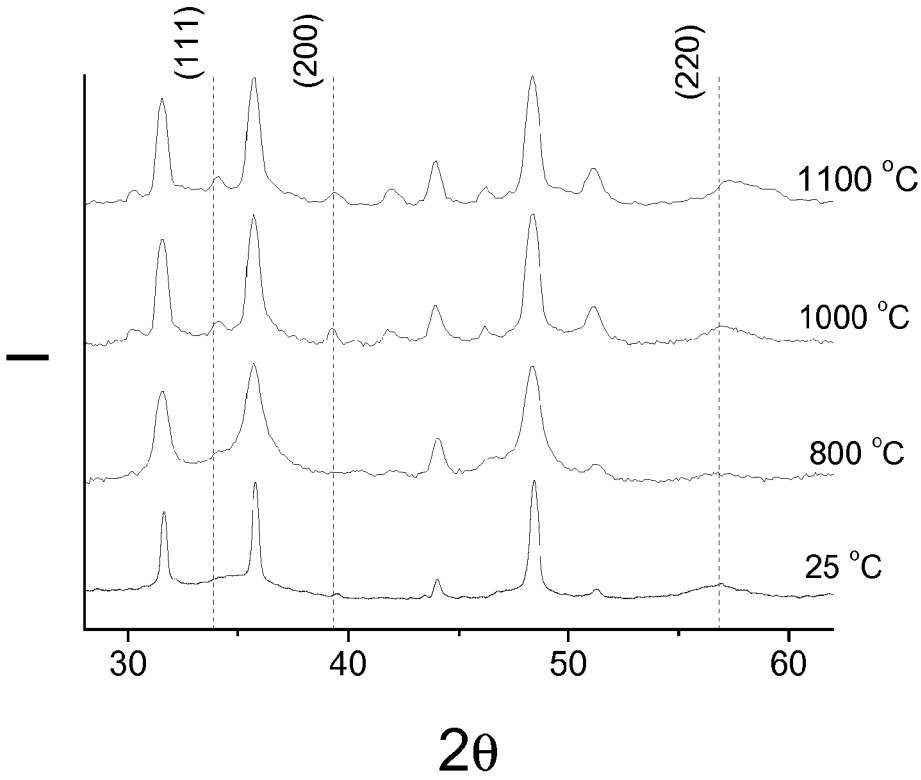
FIG. 2; X-ray diffraction patterns vs. heat treatment temperature.

The XRD patterns of the as-deposited layers and heat treated layers were obtained using Cu K alpha radiation and a θ-2θ configuration. The layer peaks, typically, are rather broad characteristic of a nanocrystalline structure. Also, the layer crystalline structure remains essentially unaffected with heat treatment temperatures up to 1100° C. As an example, FIG. 2 shows XRD patterns of $(Zr_{0.17}Al_{0.83})N$ layer as a function of heat treatment temperature with the cubic phase of (Zr,Al)N marked with dotted lines, the unindexed peaks originate from tungsten carbide and possibly also with a small contribution from a hexagonal (Zr,Al)N phase.

Figure 3:
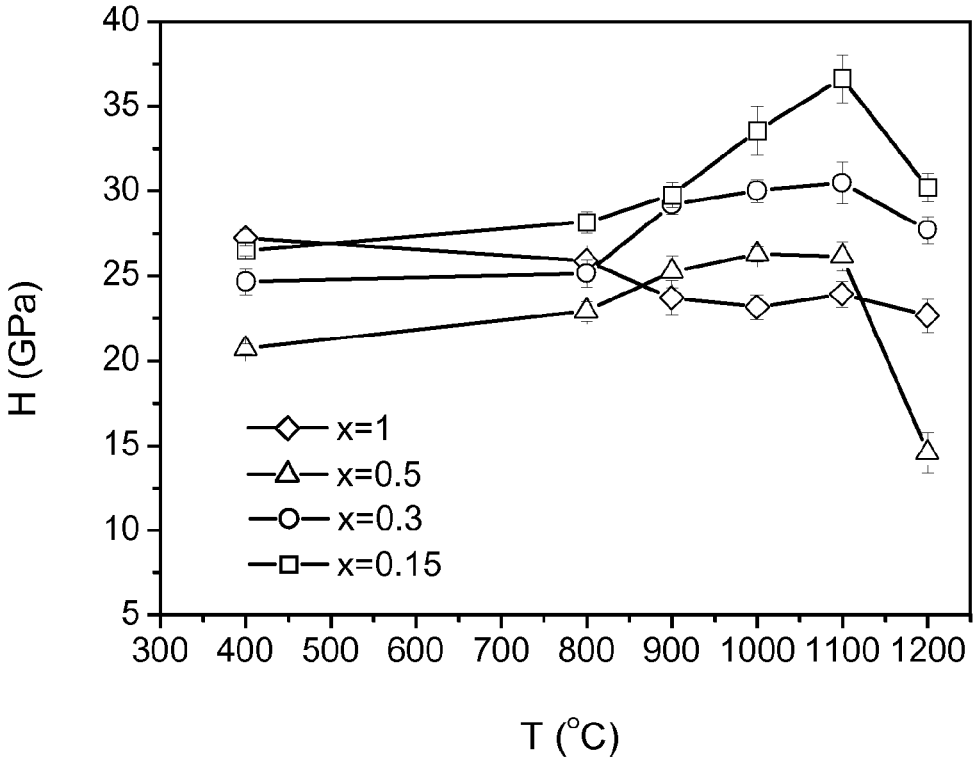
FIG. 3; Hardness vs. heat treatment temperature and composition, x, in $(Zr_xAl_{1-x})N$ where □: x=0.17, ○: x=0.30, Δ: x=0.50 and ◇: x=1.00.

Hardness data was estimated by the nanoindentation technique of the layers using a UMIS nanoindentation system with a Berkovich diamond tip and a maximum tip load of 25 mN. Indentations were made on polished surfaces. FIG. 3 shows the hardness (H) of $(Zr_xAl_{1-x})N$ layers as a function of heat treatment and composition, x. For $x \leqq 0.30$, an unexpected increase of the age hardening is obtained. Specifically, the increase in hardness for x=0.17 is more than 35%, i.e., with values from 27 to 37 GPa.

Figure 4:
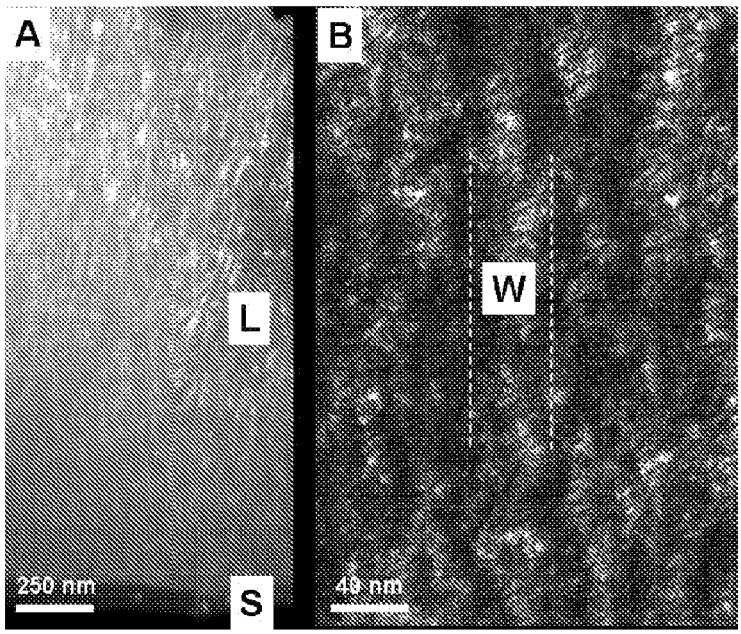
FIG. 4; A transmission electron microscope (TEM) dark field micrograph over the (111) and (200) diffraction spots of a $(Zr_{0.17}Al_{0.83})N$ layer showing in (A) a low magnification overview of the layer and in (B) a higher magnification.

Cross-sectional dark field transmission electron microscopy (TEM) was used to study the microstructure of the layers with a FEI Technai G$^2$ TF 20 UT operated at 200 kV. The sample preparation comprised standard mechanical grinding/polishing and ion-beam sputtering. FIGS. 4A and 4B show cross sectional dark field TEM micrograph over (111) and (200) reflections of a $(Zr_{0.17}Al_{0.83})N$ layer according to the invention. FIG. 4A shows that the layer (L) exhibits a columnar microstructure with an average columnar width (FIG. 4B), W, of 40 nm, comprising crystalline regions (light contrast) with size <50 nm.

Example 2

Inserts from example 1 were tested according to:

Geometry: CNMA120408-KR

Application: Longitudinal turning

Work piece material: SS1672

Cutting speed: 240 m/min

Feed: 0.2 mm/rev

Depth of cut: 2 mm

Flank wear was measured after 5 min of turning with the following results.

TABLE 2

| Layer | x in $(Zr_xAl_{1-x})N$ | Flank wear (mm) |
|---|---|---|
| zr-211 | 0.02 | — |
| zr-221 | 0.1 | 0.12 |
| zr-111 | 0.17 | <0.1 |
| zr-121 | 0.17 | <0.1 |
| zr-131 | 0.19 | — |
| zr-011 | 0.26 | — |
| zr-021 | 0.3 | 0.15 |
| zr-031 | 0.33 | — |
| zr-041 | 0.48 | — |
| zr-051 | 0.5 | 0.2 |
| zr-012 | 0.65 | — |
| zr-062 | 0.76 | 0.25 |
| zr-092 | 0.99 | 0.23 |

A flank wear <0.2 with the selected cutting data is satisfactory.

The invention claimed is:

1. A cutting tool insert, comprising:

a body, the body being formed from cemented carbide, cermet, ceramics, high speed steel, polycrystalline diamond or polycrystalline cubic boron nitride; and a hard and wear resistant coating deposited on the body, said coating comprising at least one layer formed from $(Zr_xAl_{1-x})N$ with $0.05<x<0.30$, having a thickness between 0.5 and 10 μm, and having a nanocrystalline columnar microstructure with a single cubic phase or a mixture of hexagonal and cubic phases.

2. The cutting tool insert according to claim 1, wherein $0.10<x<0.25$.

3. The cutting tool insert according to claim 1, wherein $0.15<x<0.20$.

4. The cutting tool insert according to claim 1, wherein the thickness is between 0.5 and 5 μm.

5. The cutting tool insert according to claim 1, wherein an average columnar width is <500 nm.

6. The cutting tool insert according to claim 1, wherein an average columnar width is <100 nm.

7. The cutting tool insert according to claim 1, wherein an average columnar width is <50 nm.

8. The cutting insert according to claim 1, wherein that the columns comprise crystalline regions with a size <100 nm.

9. The cutting insert according to claim 1, wherein that the columns comprise crystalline regions with a size <50 nm.

10. The cutting insert according to claim 1, wherein that the columns comprise crystalline regions with a size <25 nm.

11. The cutting tool insert according to claim 1, wherein that said layer has a hardness >25 GPa.

12. The cutting tool insert according to claim 1, wherein that said layer has a hardness of 27 to 37 GPa.

13. The cutting tool tool insert according to claim 1, wherein said body is further coated with at least one of a) an inner single- and/or multilayer coating of TiN, TiC, Ti(C,N) or (Ti,Al)N, or b) an outer single- and/or multilayer coating of TiN, TiC, Ti(C,N), (Ti,Al)N or oxides, to a total coating thickness of 0.7 to 20 μm.

14. The cutting tool tool insert according to claim 1, wherein said body is further coated with at least one of a) an inner single- and/or multilayer coating of TiN, TiC, Ti(C,N) or (Ti,Al)N, or b) an outer single- and/or multilayer coating of TiN, TiC, Ti(C,N), (Ti,Al)N or oxides, to a total coating thickness of 1 to 10 μm.

15. The cutting tool tool insert according to claim 1 wherein said body is further coated with at least one of a) an inner single- and/or multilayer coating of TiN, TiC, Ti(C,N) or (Ti,Al)N, or b) an outer single- and/or multilayer coating of TiN, TiC, Ti(C,N), (Ti,Al)N or oxides, to a total coating thickness of 2 to 7 μm.

16. A cutting tool insert, comprising:

a body, the body being formed from cemented carbide, cermet, ceramics, high speed steel, polycrystalline diamond or polycrystalline cubic boron nitride; and a hard and wear resistant coating deposited on the body, said coating comprising at least one layer formed from $(Zr_xAl_{1-x})N$ with $0.10<x<0.25$, having a thickness between 0.5 and 5 μm, and having a nanocrystalline columnar microstructure with a single cubic phase or a mixture of hexagonal and cubic phases.

17. The cutting tool insert according to claim 16, wherein $0.15<x<0.20$.

18. The cutting tool insert according to claim 16 wherein an average columnar width is <500 nm.

19. The cutting insert according to claim 16, wherein that the columns comprise crystalline regions with a size <100 nm.

20. The cutting tool tool insert according to claim 16, wherein said body is further coated with at least one of a) an inner single- and/or multilayer coating of TiN or (Ti,Al)N, or b) an outer single- and/or multilayer coating of TiN or (Ti,Al)N, to a total coating thickness of 0.7 to 20 μm.

* * * * *